US008056255B2

(12) United States Patent
Smith et al.

(10) Patent No.: US 8,056,255 B2
(45) Date of Patent: Nov. 15, 2011

(54) MANURE REMOVAL AND DRYING SYSTEM

(75) Inventors: Nathaniel Lee Smith, Milford, IN (US); Michael E. Krehl, Kendalville, IN (US); Todd J. Martin, Claypool, IN (US)

(73) Assignee: CTB, Inc., Milford, IN (US)

( * ) Notice: Subject to any disclaimer, the term of this patent is extended or adjusted under 35 U.S.C. 154(b) by 979 days.

(21) Appl. No.: 11/972,930

(22) Filed: Jan. 11, 2008

(65) Prior Publication Data

US 2008/0209753 A1 Sep. 4, 2008

Related U.S. Application Data

(60) Provisional application No. 60/885,099, filed on Jan. 16, 2007.

(51) Int. Cl.
*F26B 19/00* (2006.01)

(52) U.S. Cl. ..... 34/214; 34/168; 34/80; 432/130; 432/139; 110/228

(58) Field of Classification Search ..... 34/60, 80, 34/90, 214, 167, 168, 242, 86, 78; 110/228; 432/130, 139
See application file for complete search history.

(56) References Cited

U.S. PATENT DOCUMENTS

| | | | | | |
|---|---|---|---|---|---|
| 1,988,677 | A * | 1/1935 | Arnold | 432/45 |
| 2,486,903 | A * | 11/1949 | Wormell | 34/447 |
| 3,571,944 | A * | 3/1971 | Duhem | 34/578 |
| 3,697,056 | A | 10/1972 | Prins, Sr. et al. | |
| 4,242,809 | A * | 1/1981 | Elder | 34/498 |
| 4,445,282 | A * | 5/1984 | Heinemans | 34/168 |
| 4,678,076 | A * | 7/1987 | Nenakhov et al. | 198/525 |
| 4,802,288 | A * | 2/1989 | Shinn et al. | 34/136 |
| 5,097,749 | A * | 3/1992 | Smith, Jr. | 454/251 |
| 5,145,460 | A * | 9/1992 | Smith, Jr. | 454/253 |
| 5,487,226 | A | 1/1996 | Hoover | |
| 5,737,850 | A * | 4/1998 | Hendrix | 34/380 |
| 7,568,297 | B2 * | 8/2009 | Pierson et al. | 34/218 |
| 7,802,377 | B2 * | 9/2010 | Kloibhofer et al. | 34/110 |
| 7,941,937 | B2 * | 5/2011 | Do | 34/381 |
| 2008/0209753 | A1 * | 9/2008 | Smith et al. | 34/214 |

FOREIGN PATENT DOCUMENTS

| | | | |
|---|---|---|---|
| EP | 45114 | A1 * | 2/1982 |
| EP | 1795517 | A1 * | 6/2007 |
| JP | 05000877 | A * | 1/1993 |
| WO | WO 9602335 | A1 * | 2/1996 |
| WO | 9607068 | | 3/1996 |
| WO | WO 2010258285 | A2 * | 5/2010 |

OTHER PUBLICATIONS

Canadian Office Action; Dated Apr. 29, 2011; Two (2) pages.

* cited by examiner

*Primary Examiner* — Stephen M. Gravini
(74) *Attorney, Agent, or Firm* — Clark Hill PLC

(57) ABSTRACT

A manure removal and drying system is used in an agricultural setting. The system includes a static pressure control system for regulating an amount of static pressure in a high pressure area of the agricultural setting, a variable speed loading system for varying a speed of operation of the system based on an amount of manure being removed and dried in the agricultural setting, a moisture sensing control system for detecting moisture from the manure in order to activate or deactivate the system, a selective capacity control system for selectively scaling a distance the manure in the agricultural setting is moved, and a friction reduction system for reducing the buildup of friction within the system caused by the movement of belts.

30 Claims, 9 Drawing Sheets

MANURE REMOVAL AND DRYING SYSTEM

CROSS-REFERENCE AND INCORPORATION BY REFERENCE

This patent application claims the benefit of domestic priority of U.S. Provisional Application Ser. No. 60/885,099, filed Jan. 16, 2007, and entitled "Manure Removal and Drying System". U.S. Provisional Application Ser. No. 60/885,099 is hereby incorporated by reference in its entirety.

FIELD OF THE INVENTION

This invention relates in general to a system for drying and removing manure from poultry or livestock houses. More particularly, the present invention concerns the use of a perforated belt manure removal and drying system.

BACKGROUND OF THE INVENTION

Operators of poultry or livestock houses, for obvious reasons, have a need to remove manure from the poultry or livestock houses. As a part of that removal, operators have also found it to be very beneficial to dry the manure as it is being removed for a number of reasons, including but not necessarily limited to, ease of handling, ease of storage, reduction in weight which make the dried manure more cost effective in shipping, disease/fly control, ease of field application/blend consistency, and very little nutrient content is lost by drying, such that it creates a more nutrient dense product relative to weight.

Current systems for the removal and drying of manure from poultry or livestock houses present many problems for the animal husbandry industry. For example, in a typical poultry house 22, as illustrated in FIG. 1, a manure removal and drying machine 21 along with a permanently placed wall 28 separate a high pressure area or room 29 from a low pressure area or room 27. The manure removal and drying machine 21 has a plurality of levels of perforated belts or conveyors 24 along which the manure travels as it is dried and removed from the poultry house 22. Air flow (depicted by arrows facing to the left in FIG. 1) into the high pressure room 29 caused by fans (not shown) running within the poultry house 22 causes static pressure to buildup in the high pressure room 29. The manure removal and drying machine 21 of the prior art allows the air flow, forced by the static pressure within the high pressure room 29, to flow into and across the manure removal and drying machine 21, typically at every other level of perforated belt 24. This air flow, however, is then forced to divert either upwardly or downwardly (FIG. 1 illustrates air flow both upwardly and downwardly, although some prior art manure removal and drying machines only allow air flow either upwardly or downwardly), through the perforations in the perforated belts 24, and out of the manure removal and drying machine 21 and into the low pressure room 27.

Such a configuration, however, does not allow for efficient operation of the entire manure removal and drying system as there is an excessive buildup of static pressure in the poultry house 22. The manure removal and drying machine 21 is only designed to allow for a small amount of air and static pressure to move therethrough from the high pressure room 29 to the low pressure room 27, i.e., for minimum ventilation of the poultry house 22. When more fans are running within the poultry house 22, extra static pressure is generated and builds up in the high pressure room 29, but this is static pressure that the manure removal and drying machine 21 does not need, thus resulting in possible inefficient operation of the manure removal and drying machine 21.

Also, typical manure removal and drying systems use a manual stop and start control (full speed or nothing), which requires constant attention from an operator, and causes inconsistent loading of the dryer system.

Further, typical manure removal and drying systems have a plurality of manure belts which are staggered relative to one another in a vertical arrangement. More specifically, material or manure traveling along a first manure belt in a first direction will be dropped onto a second manure belt traveling in a second direction. The manure is then dropped onto a third manure belt traveling in the same direction as the first belt, and then the manure is dropped onto a fourth belt traveling in the same direction as the second belt, and so on and so forth for as many manure belts are provided in the manure removal and drying system. Such a configuration wastes time and energy, however, as the entire operating capacity of the manure and removal drying system is not needed when the amount of manure is minimal. Furthermore, when maintenance is required on one or more of the conveyor belts, the entire system must be shut down in order to perform the maintenance.

Also, the belts 24 of the manure removal and drying machine and system are typically supported by a fixed member, such as a support tube or any other structural and/or functional equivalent thereof. Because these members are fixed, a large amount of friction is generated by the belts 24 moving over the fixed members, thus limiting the length at which the belts 24 can operate. Currently, it is believed that most belts 24 in manure removal and drying machines/systems are limited to a length of approximately 260 feet. It would be desirable to increase the length of the belts 24 for a variety of reasons, including but not limited to, the possible removal of levels of belts 24 in the manure removal and drying machine 21 and the ability to lengthen the drying time of the manure within the manure removal and drying machine 21.

These and other drawbacks are solved by the present invention.

SUMMARY OF THE INVENTION

Briefly, and in accordance with the foregoing, the invention provides a manure removal and drying system for use in an agricultural setting such as a poultry or livestock house. The manure removal and drying system includes a manure removal and drying machine, which is preferably made up of a plurality of continuous conveyor belts which are staggered relative to one another in a vertical arrangement. The manure removal and drying system also includes an actuator configured to activate and/or deactivate the conveyor belts as well as vary the speed of the conveyor belts. The actuator is in communication with a controller that instructs the actuator to activate and/or deactivate the conveyor belts as well as vary the speed of the conveyor belts based upon preprogrammed levels of the amount of manure on the conveyor belts as well as preprogrammed levels of moisture within the manure.

A moisture sensor configured to sense the level of moisture in the manure is operatively associated with one or more of the conveyor belts of the manure removal and drying machine and in communication with the controller. When the moisture sensor communicates to the controller a level of moisture in the manure equal to or greater than the preprogrammed moisture level in the controller, the controller instructs the actuator to activate the conveyor belts. Likewise, when the moisture sensor communicates a level of moisture below the preprogrammed level of moisture in the controller, the controller instructs the actuator to deactivate the conveyor belts. Furthermore, the controller may have a plurality of preprogrammed moisture levels that when reached, the controller will instruct the actuator to vary the speed of the conveyor belts rather than simply activate or deactivate the conveyor belts.

Similarly, a material position sensor configured to sense the amount of manure on one or more of the conveyor belts is operatively associated with the conveyor belts and is in communication with the controller. When the material position sensor communicates to the controller a specified amount of manure on the conveyor belts, the controller instructs the actuator to increase or decrease the speed of the conveyor belts based upon the preprogrammed amounts of manure in the controller.

The plurality of staggered conveyor belts of the manure removal and drying machine are scalable. For example, a first conveyor belt is positioned above a second conveyor belt, which is in turn positioned above a third conveyor belt, which is then in turn positioned above a fourth conveyor belt. The ends of the first and third conveyor belts are generally coplanar, and the ends of the second and fourth conveyor belts are generally coplanar, but the ends of the first and third conveyor belts are offset from the ends of the second and fourth conveyor belts. Also, the first and third conveyor belts move in a same direction, and the second and third conveyor belts move in a same direction that is opposite the direction of the first and third conveyor belts. Thus, manure will travel along the first conveyor belt and be dropped onto the second conveyor belt, then travel along the second conveyor belt and be dropped onto the third conveyor belt, then travel along the third conveyor belt and be dropped onto the fourth conveyor belt. However, when deemed appropriate or necessary, the second conveyor belt can be moved out of a co-planar relationship with the fourth conveyor belt, and into a co-planar relationship with the first and third conveyor belts. Thus, manure traveling along the first conveyor belt will be dropped to the fourth conveyor belt effectively bypassing both the second and third conveyor belts.

Furthermore, the static pressure generated by the manure removal and drying system is controlled by a static pressure control system. The manure removal and drying machine along with a portion of static pressure control system separate a high pressure area from a low pressure area. The static pressure control system includes a pressure bypass door between the high pressure and low pressure areas that is configured to open such that the high pressure area is in communication with the low pressure area in order to reduce the pressure in the high pressure area. The bypass door is opened and closed by a bypass actuator. The static pressure control system further includes a static pressure sensor positioned within the high pressure area. The static pressure sensor is in communication with a bypass controller that is in turn in communication with the bypass actuator. The bypass controller is programmed with at least one predetermined level of static pressure. Thus when the bypass controller receives input from the static pressure sensor indicating a level of static pressure in the high pressure area equal to or greater than the programmed level of static pressure in the bypass controller, the bypass controller instructs the bypass actuator to open the bypass door.

The length of the perforated belts/conveyors of a manure removal and drying machine is also greatly increased over those of the prior art by incorporating a friction reduction system within the manure removal and drying machine. The friction reduction system includes a tube member or the like that is sized to fit over and around the tube or member that is fixedly secured in place to support the belts along their length. The tube member is preferably round, larger than the support member, and is rotatable about the support member such that as the perforated belt moves along the tube member, the tube member will roll or move around the support member, thereby reducing the amount of friction generated between the perforated belts and the support member. This reduction in friction allows for the length of the perforated belts to be substantially increased.

BRIEF DESCRIPTION OF THE DRAWINGS

The features of the invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENTS

Figure 1:
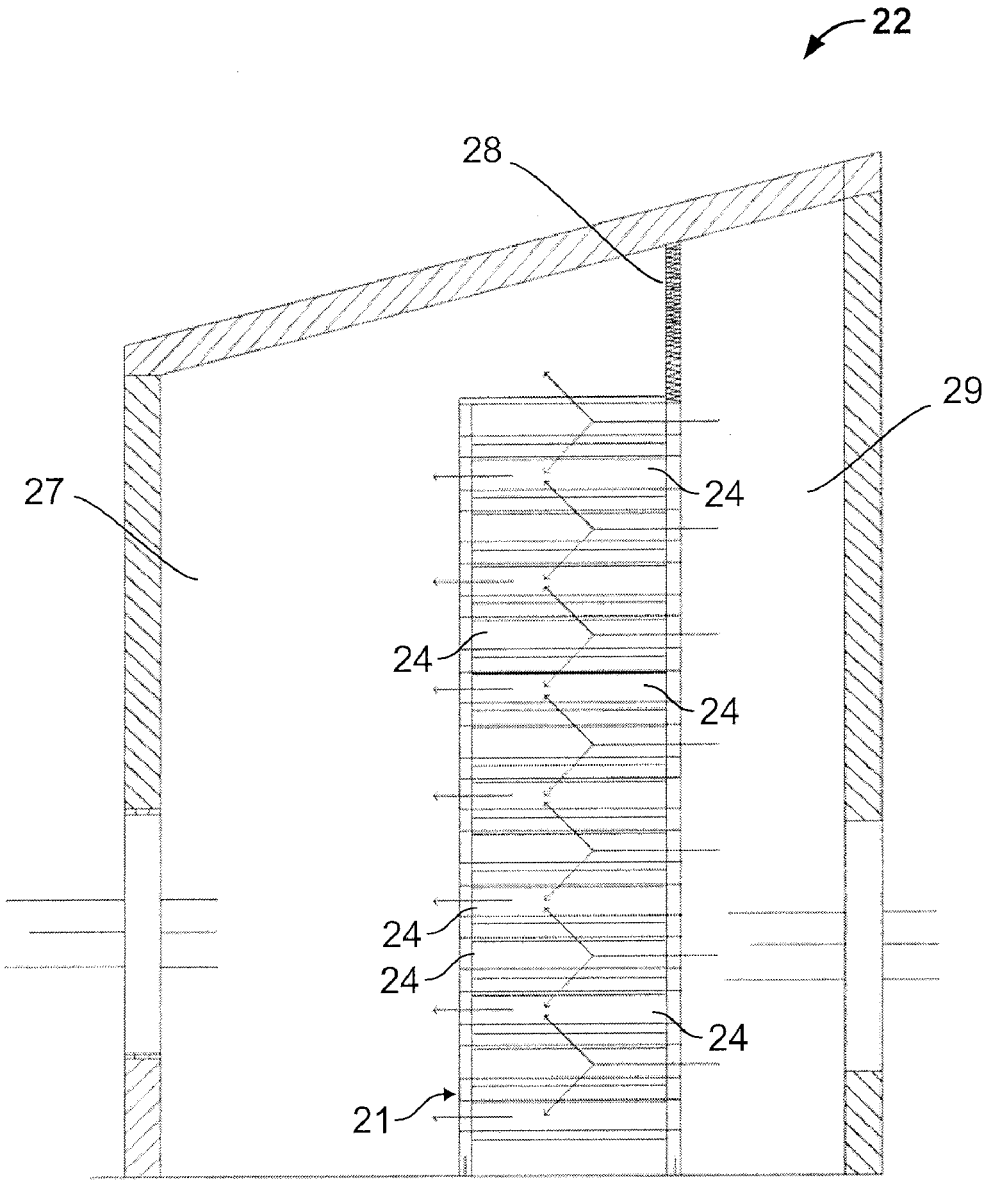
FIG. 1 (PRIOR ART)
FIG. 1 is a side view of an interior of a typical prior art poultry house in which a manure removal and drying machine along with a permanently placed wall separate a high pressure room from a low pressure room.

While this invention may be susceptible to embodiment in different forms, there is shown in the drawings and will be described herein in detail, specific embodiments with the understanding that the present disclosure is to be considered an exemplification of the principles of the invention, and is not intended to limit the invention to that as illustrated.

Turning now to the drawings, the illustrated manure removal and drying system 20 desirably is adapted to be used in connection with a livestock or poultry house 22 as shown in FIGS. 2-14. As illustrated in FIGS. 2-8, the manure removal and drying system 20 has a manure removal and drying machine 23 which includes a plurality of manure conveyors 24, which are preferably continuous perforated belts which are staggered relative to one another in a vertical arrangement. More specifically, a first manure belt 24*a* is positioned above a third manure belt 24*c* with the ends 26*a*, 26*c* of the first and third manure belts 24*a*, 24*c* being generally co-planar, a second manure belt 24*b* is positioned above a fourth manure belt 24*d* with the ends 26*b*, 26*d* of the second and fourth manure belts 24*b*, 24*d* being generally co-planar, but the ends 26*a*, 26*c* are not generally co-planar with the ends 26*b*, 26*d*, but rather are offset from one another. The second manure belt 24*b* is vertically positioned between the first and third manure belts 24*a*, 24*c* and the third manure belt 24*c* is vertically positioned between the second and fourth manure belts 24*b*, 24*d*. Also, the first and third manure belts 24*a*, 24*c* generally move in the same direction, whereas the second and fourth manure belts 24*b*, 24*d* generally move in the opposite direction. Thus, material or manure traveling along the first manure belt 24*a* will be dropped onto the second manure belt 24*b*, which in turn will be dropped onto the third manure belt 24*c*, which in turn will be dropped onto the fourth manure belt 24*d*, and so on and so fourth for as many manure belts 24 are provided in the manure removal and drying system 20, as it is to be understood that the manure removal and drying machine 23 may have more than four manure belts 24.

The manure removal and drying machine 23 includes a selective capacity control system 25 that provides for at least one of the manure belts 24, for instance the second manure belt 24*b*, to be configured to be moved such that the end 26*b* of the second manure belt 24*b* be moved out of co-planar relation with the end 26*d* of the fourth manure belt 24*d* and into co-planar relation with the ends 26*a*, 26*c* of the first and third manure belts 24*a*, 24*c*. Thus, the second and third manure belts 24*b*, 24*c* are effectively bypassed such that manure traveling on the first manure belt 24*a* will be dropped onto the fourth manure belt 24*d*.

This selective capacity control system 25 of the manure removal and drying system 20 allows the whole manure and removal drying machine 23 to be scaled to the desired moisture content and drying time. The selective capacity control system 25 of the manure removal and drying system 20 also allows the operator to perform service on some of the manure belts 24, for instance the second and third manure belts 24*b*, 24*c* as they need not be running during bypass operation, yet still run the rest of the manure belts 24. Thus, levels of the manure removal and drying machine 23 are skipped two at a time, shrinking the operating capacity of the manure removal and drying system 20.

Preferably, the manure removal and drying system 20 includes a static pressure control system 30, a moisture sensing control system 50, an automatic variable speed loading system 70, and a friction reduction system 90.

Figure 9:
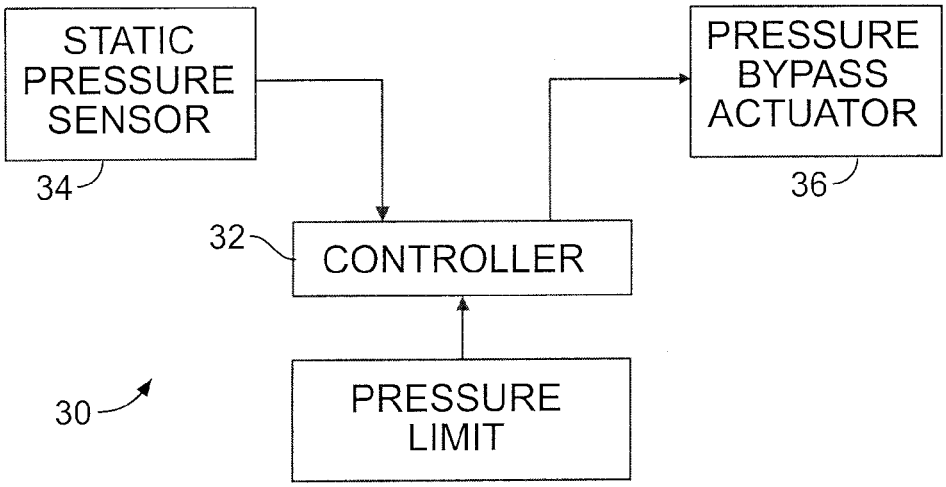
FIG. 9 is a flow chart illustrating a portion of the static pressure control system.

The static pressure control system 30, as depicted in FIG. 9, allows the manure removal and drying system 20 to operate somewhat independently of the typical building ventilation, including the minimal ventilation through the manure removal and drying machine 23, such as that described in the prior art with regard to the manure removal and drying machine 21. The static pressure control system 30 includes a controller 32, a static pressure sensor 34, a pressure bypass actuator 36 and a pressure bypass 38. As shown in FIG. 1-6, manure removal and drying machines 21, 23 of the prior art and of the present invention are typically in a low pressure area/room 27 of a poultry house 22. The manure removal and drying machine 23 separates the low pressure area/room 27 from a high pressure area/room 29. As previously discussed, prior art arrangements include a permanently placed wall 28 that further separates the low pressure area/room 27 from the high pressure area/room 29.

The static pressure control system 30 allows for a more efficient operation of fans within the poultry house 22 by limiting the buildup of static pressure. The static pressure control system 30 further allows for adjustment of manure moisture without changing building ventilation controls. The static pressure control system 30 of the manure removal and drying system 20 also allows operators to compensate for seasons and weather.

Figure 2:
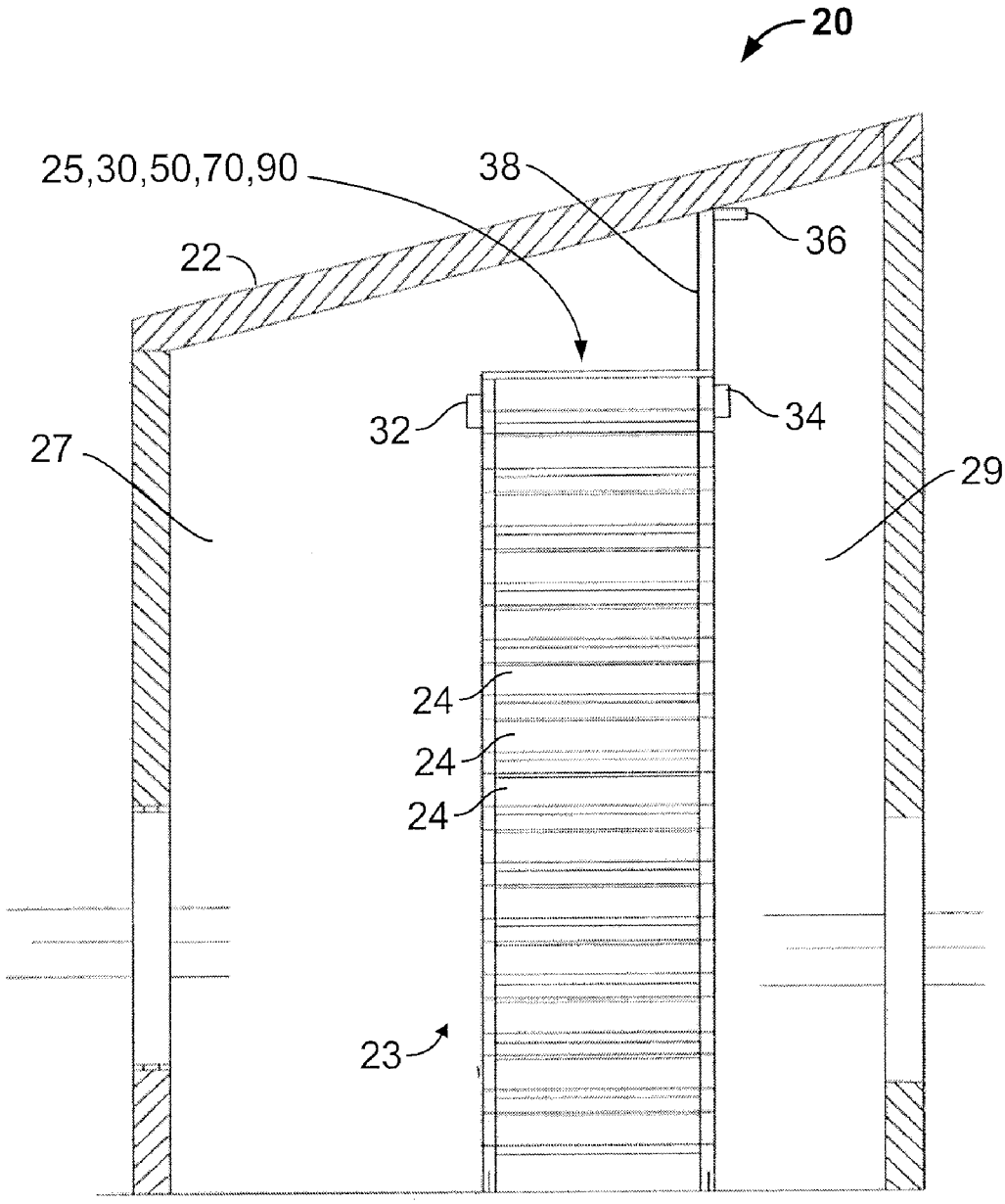
FIG. 2 is a side view of an interior of a poultry house incorporating various systems of a manure removal and drying system of the present invention, with a pressure bypass of a static pressure control system being in a closed position.
Figure 3:
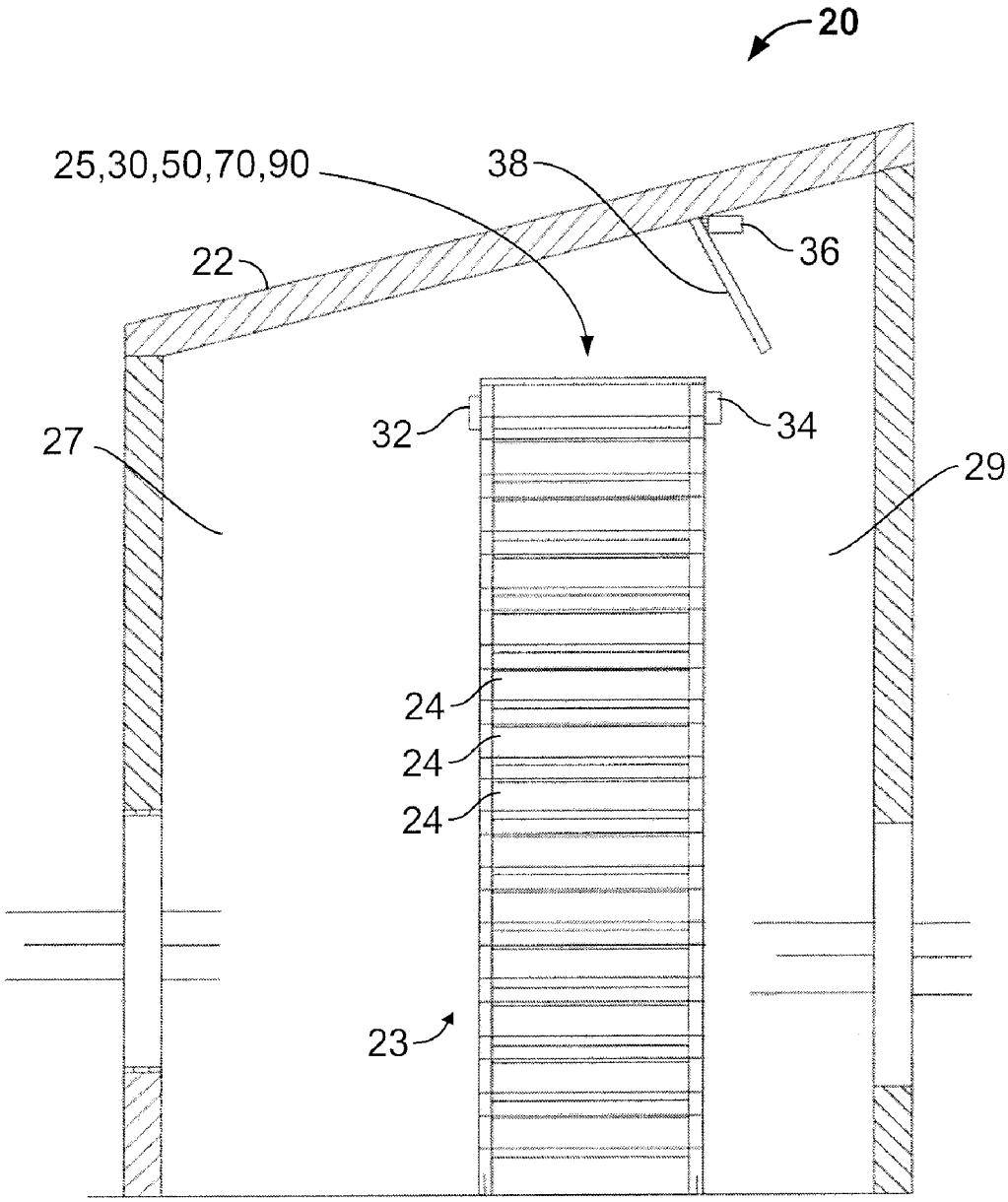
FIG. 3 is a side view of an interior of a poultry house depicted in FIG. 2, but with the pressure bypass being in an open position.
Figure 4:
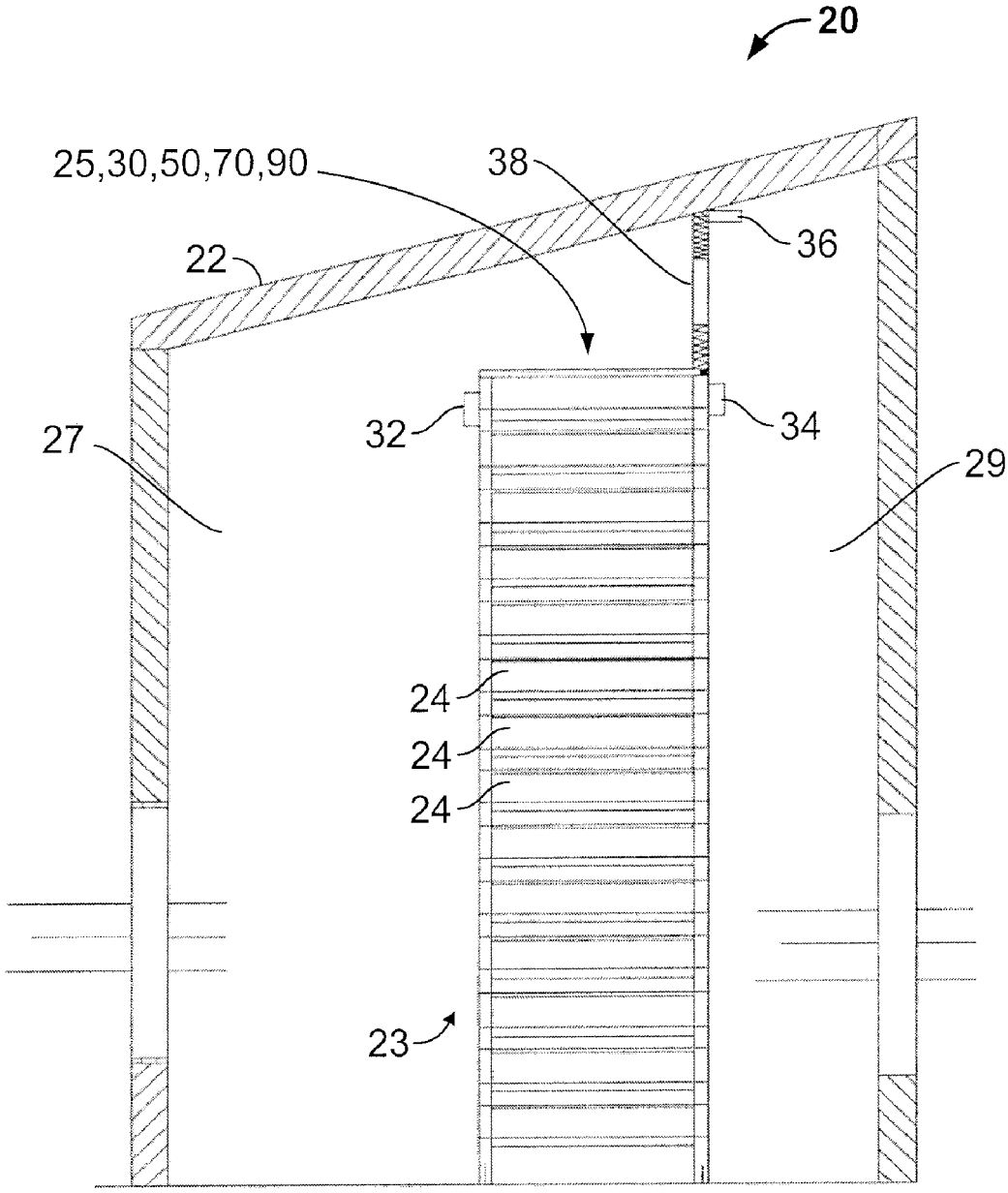
FIGS. 4 and 5 are side views of an interior of a poultry house incorporating an alternative embodiment of the pressure bypass being in both a closed position (FIG. 4) and an open position (FIG. 5)
Figure 5:
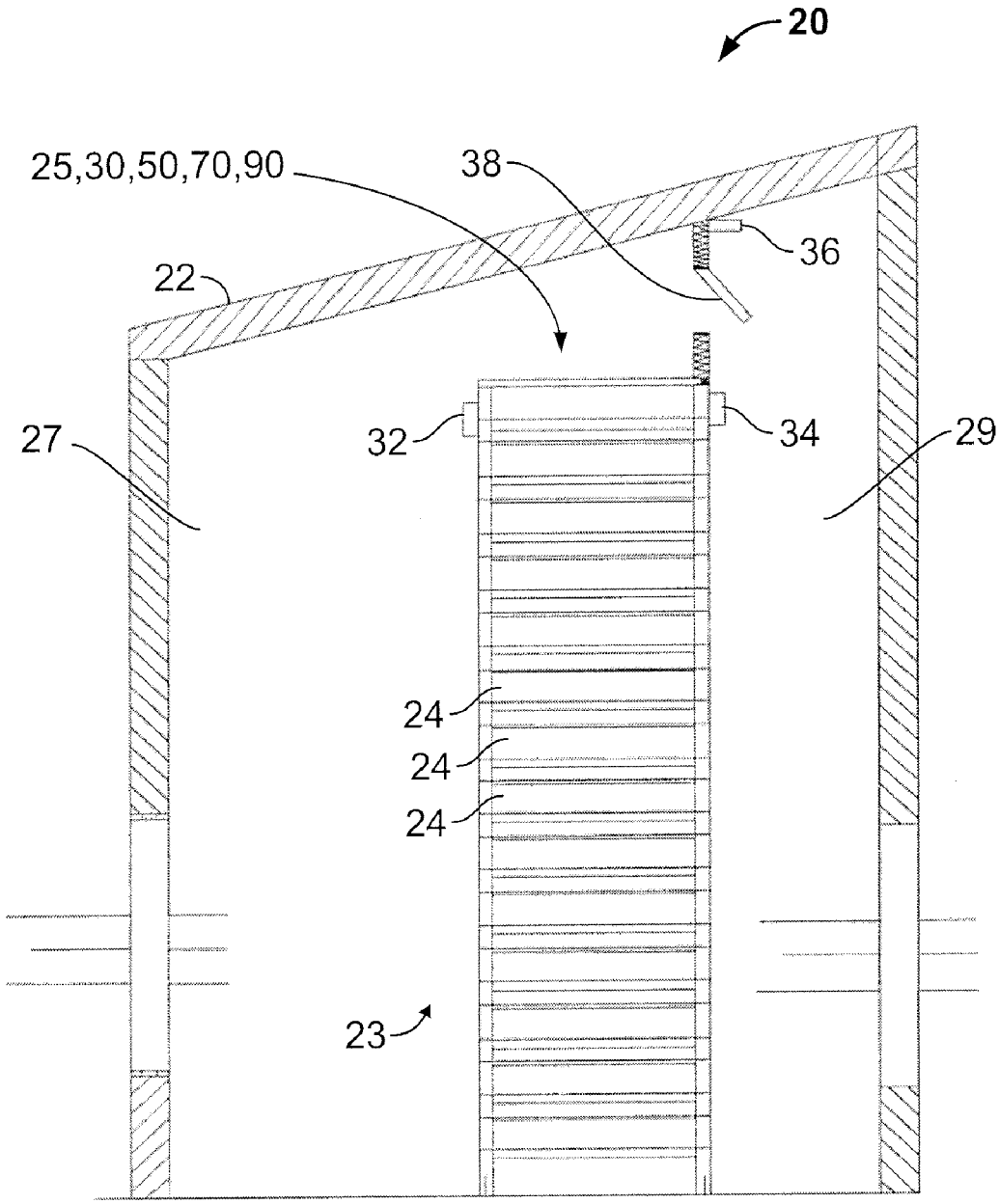

As best illustrated in FIGS. 2-6, the pressure bypass 38 of the static pressure control system 30 of the manure removal and drying system 20 replaces the permanently placed wall 28 in prior art arrangements. The static pressure sensor 34 is positioned in the high pressure area/room 29 and is in communication with the controller 32. The controller 32 controls the pressure bypass actuator 36 which, in turn, is operatively associated with the pressure bypass 38. The controller 32 may dictate that the pressure bypass 38 be in a closed position, as illustrated in FIGS. 2 and 4, such that the pressure bypass 38 acts like the permanently placed wall 28. Conversely, the controller 32 may dictate that the pressure bypass 38 be in an open position, as illustrated in FIGS. 3 and 5, such that the high pressure area/room 29 be in communication with the low pressure area/room 27, in order to reduce the pressure in the high pressure area/room 29. The controller 32 is configured to have an operator input one or more pressure levels/limits at which, based on the sensing of the static pressure by the static pressure sensor 34 within the high pressure area/room 29, the controller 32 dictates the opening/closing of the pressure bypass 38. For instance, at a first pressure level/limit, the controller 32 is programmed to dictate that the pressure bypass 38 be closed. At a second pressure level/limit higher than the first pressure level/limit, the controller is programmed to dictate that the pressure bypass 38 be opened to a certain degree of openness. It is understood that the controller 32 may be programmed with more than two pressure levels/limits at which the controller 32 dictates that the pressure bypass 38 be opened to different degrees of openness.

Figure 6:
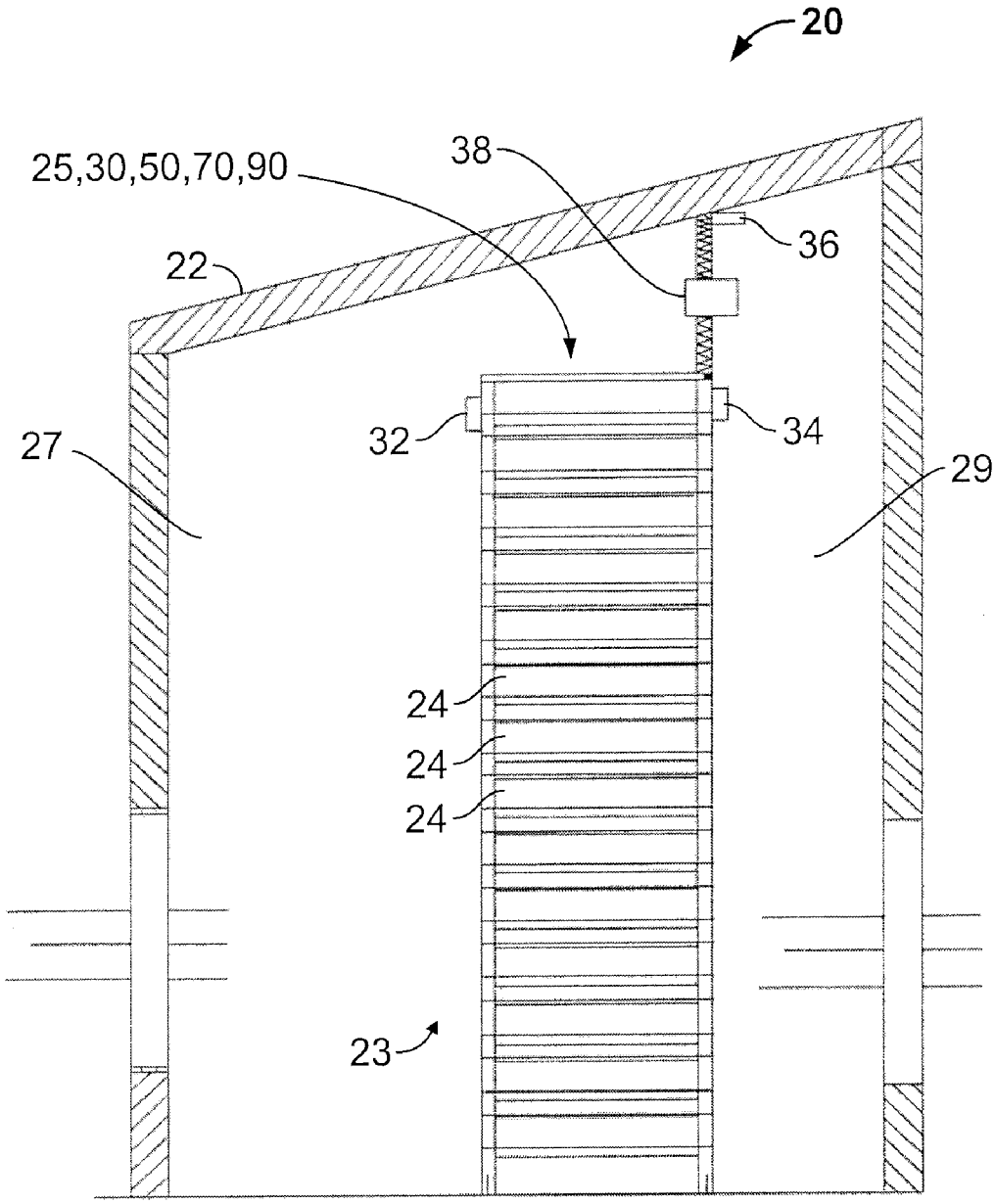
FIG. 6 is a side view of an interior of a poultry house incorporating another alternative embodiment of the pressure bypass.
Figure 7:
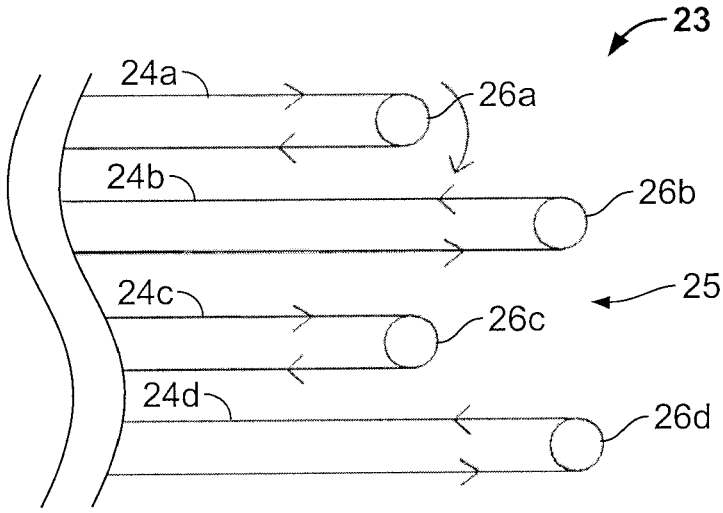
FIG. 7 is a side view of a portion of a selective capacity control system of the manure removal and drying system of the present invention.
Figure 8:
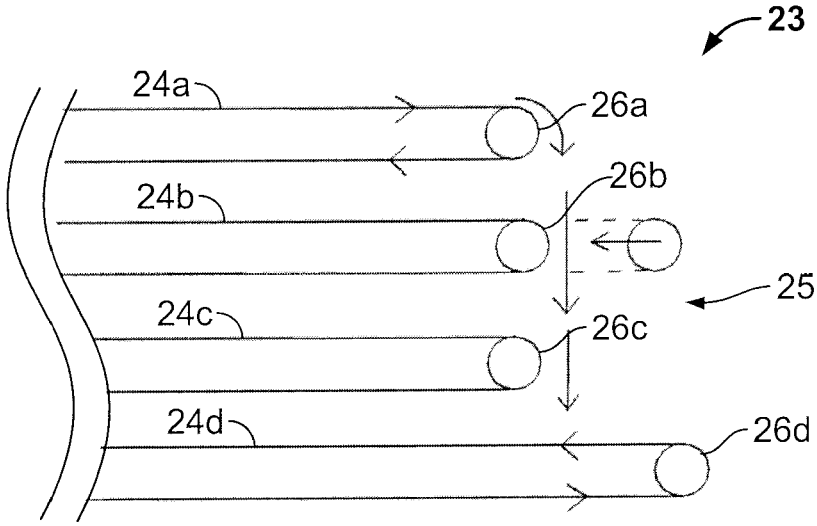
FIG. 8 is a side view of a portion of the selective capacity control system showing one of multiple levels of conveyors moved out of alignment with the other levels such that it can be bypassed during operation of the manure removal and drying system.

The pressure bypass 38 may be in the form of a partition configured to open and close as shown in FIGS. 2 & 3, or as a door within a partition that is configured to open and close as shown in FIGS. 4 & 5. It is also contemplated that the pressure bypass 38 can be a valve that can open and close to allow communication between the high pressure area/room 29 and the low pressure area/room 27, as generally shown in FIG. 6.

Figure 10:
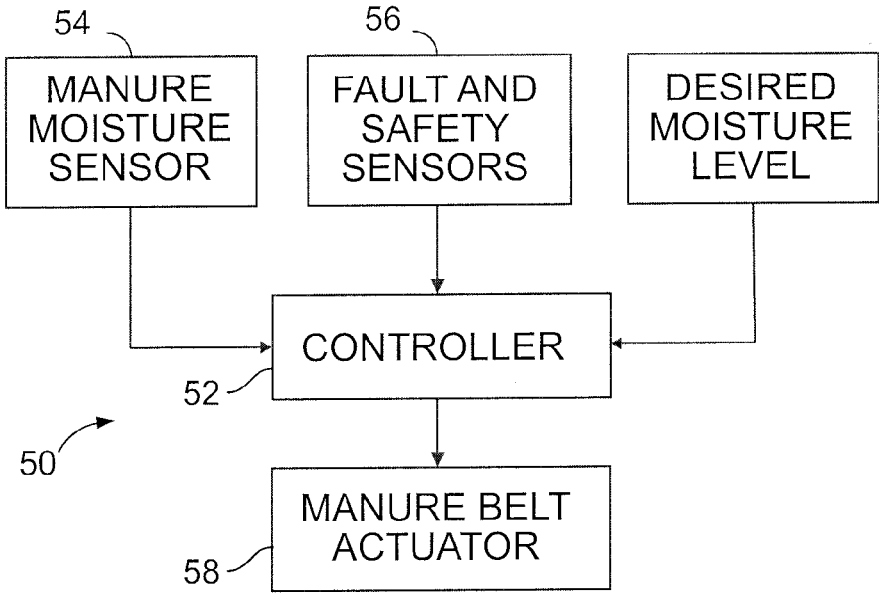
FIG. 10 is a flow chart illustrating a portion of a moisture sensing control system of the manure removal and drying system of the present invention.
Figure 11:
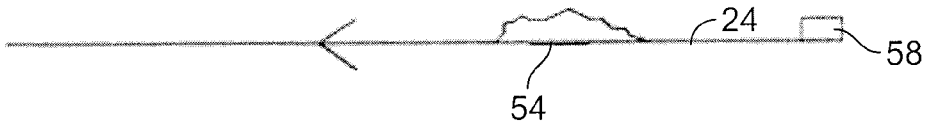
FIG. 11 is a side view of another portion of the moisture sensing control system.

The moisture sensing control system 50 of the manure removal and drying system 20, as depicted in FIGS. 10 & 11, includes a controller 52. In the present illustrated embodiment, the controller 52 of the moisture sensing control system 50 is described and illustrated as being separate from the controller 32 of the static pressure control system 30, but it is to be understood that a single controller may be used for both systems 30, 50. The moisture sensing control system 50 also includes a manure moisture sensor 54, a safety sensor 56, and a manure belt actuator 58. The manure moisture sensor 54 and the safety sensor 56 are in communication with the controller 52. The controller 52 controls the manure belt actuator 58 which, in turn, is operatively associated with a manure belt 24 in order to activate or deactivate the manure belt 24. The controller 52 dictates when the manure belt 24 runs and how long the manure belt 24 runs. The manure moisture sensor 54 is associated with the manure belt 24 in order to sense the moisture of the manure on the manure belt 24. The controller 52 is configured to have an operator input one or more desired moisture levels at which, based on the sensing of moisture by the manure moisture sensor 54, the controller 52 dictates the running of the manure belt 24. The safety sensor 56 is associated with the manure belt 24 in order to sense any malfunction in the manure belt 24. If a malfunction is sensed by the safety sensor 56, the controller 52 stops the manure belt 24 regardless of the level of moisture of manure on the manure belt 24. It is to be understood that the manure belt 24 of the moisture sensing control system 50 is the same as the manure belts 24 illustrated in FIGS. 7 & 8.

The moisture sensing control system 50 is a labor saving device. The moisture sensing control system 50 allows manure belts 24 to automatically move based on the moisture level of the manure. The moisture sensing control system 50 also will allow manure removal and drying systems 20 to operate at peak efficiency, with operators specifying moisture content.

Figure 12:
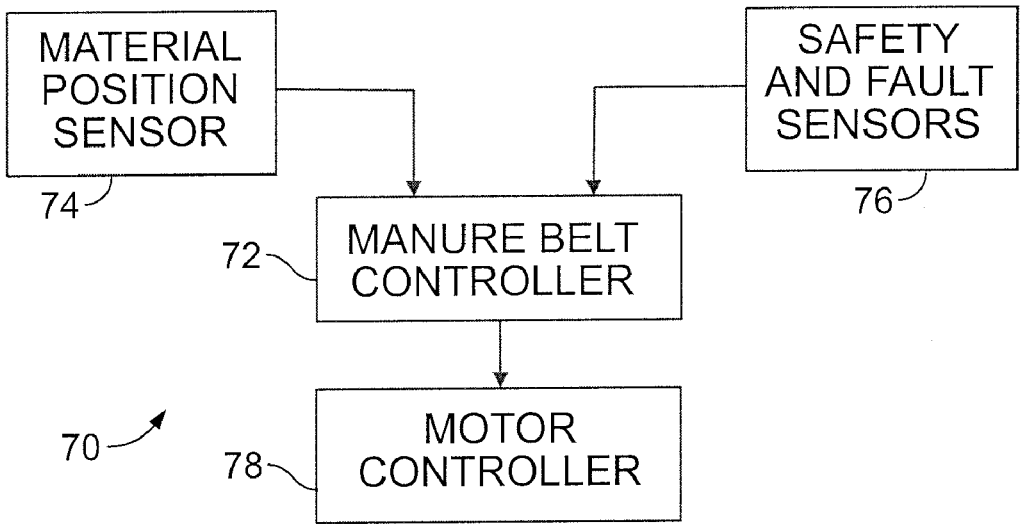
FIG. 12 is a flow chart illustrating a portion of an automatic variable speed loading system of the manure removal and drying system of the present invention.
Figure 13:
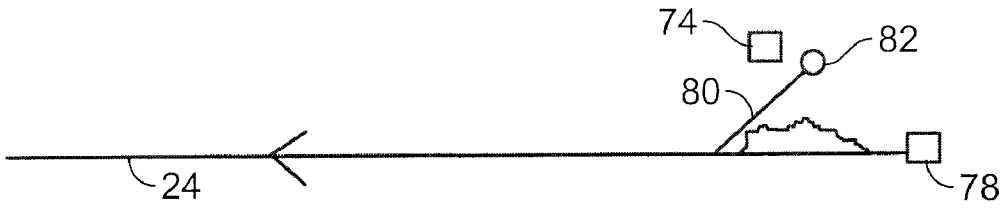
FIG. 13 is side view of another portion of the automatic variable speed loading system.

As illustrated in FIGS. 12 & 13, an automatic variable speed loading system 70 of the manure removal and drying system 20 includes a manure belt controller 72. Again, in the present illustrated embodiment, the manure belt controller 72 of the variable speed loading system 70 is described and illustrated as being separate from the controller 32 of the static pressure control system 30, and the controller 52 of the moisture sensing control system 50, but it is to be understood that a single controller may be used for all three systems 30, 50, 70. The automatic variable speed loading system 70 also includes a material position sensor 74, a safety sensor 76, a variable speed motor drive control 78, and a flapper member 80. The material position sensor 74 and the safety sensor 76 are in communication with the manure belt controller 72. The safety sensor 76 is associated with the manure belt 24 in order to sense any malfunction in the manure belt 24. If a malfunction is sensed by the safety sensor 76, the controller 72 stops the manure belt 24 regardless of the amount of manure on the manure belt 24. The safety sensor 76 is described and illustrated as being separate from the safety sensor 56, but it is to be understood that a single safety sensor may be used for both systems 50, 70. The manure belt controller 72 controls the variable speed motor drive control 78 which, in turn, is connected to the manure belt 24 in order to control the speed at which the manure belt 24 runs. The flapper member 80 is positioned above the manure belt 24 at an initial angle and is configured to pivot about a fulcrum point 82. The material position sensor 74 is associated with the flapper member 80 and senses an angle or movement of the flapper member 80 relative to the manure belt 24. During operation, the manure will be transported along the manure belt 24 and will come into contact with the flapper member 80. Depending on the amount or volume of the manure traveling along the manure belt 24, the flapper member 80 will pivot about the fulcrum point 82 and the manure position sensor 74 will sense the movement and relay this information to the manure belt controller 72. The larger the volume of manure sensed by the manure position sensor 74, the faster the manure belt controller 72 and the variable speed motor drive controller 78 will dictate that the manure belt 24 be moved. Likewise, the smaller the volume of manure sensed by the manure position sensor 74, the slower the manure belt controller 72 and the variable speed motor drive controller 78 will dictate that the manure belt 24 be moved. Thus, the manure belt 24 is preferably always running, but can, of course, be stopped if desired.

The automatic variable speed loading system 70 allows for more consistent, rapid loading of a manure removal and drying system 20. Current systems use a stop and start control (full speed or nothing), but the automatic variable speed loading system 70 allows for consistent flow of material by changing speed based on the amount of the material being moved on the manure belt.

Figure 14:
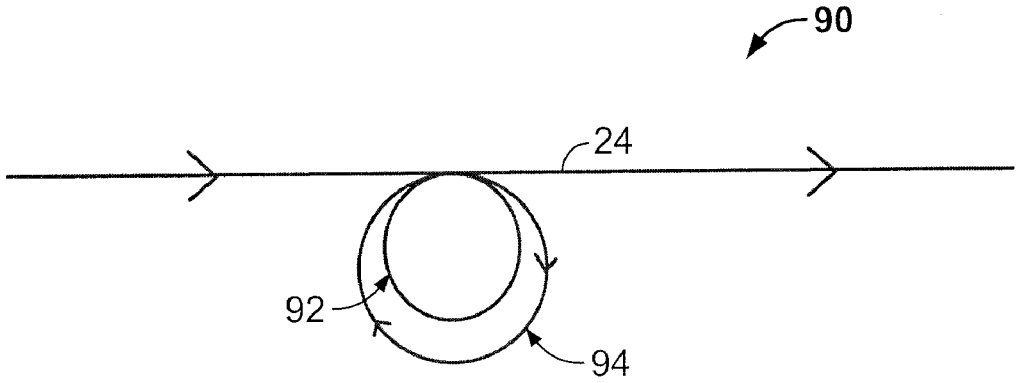
FIG. 14 is a side view of a friction reduction system of the manure removal and drying system of the present invention.

The friction reduction system 90, depicted in FIG. 14, provides for a reduction in the amount of friction between the perforated belts 24 and members 92 which support the perforated belts 24 and over which the perforated belts 24 travel. The members 92 are fixedly positioned within the manure removal and drying machine 23 such that the perforated belts 24 sit on top thereof and travel across same. As the members 92 are fixed in position, there is a substantial amount of friction between the belts 24 and the members 92. The members 92 may be of any configuration, but are illustrated as a tube-like member in FIG. 14 that is preferably made of metal. It is to be understood that other members 92 that are generally equivalent either structurally and/or functionally may also be used.

The friction reduction system 90 of the present invention incorporates the use of a separate member 94 that is positioned around the members 92, in a non-fixed manner, such that the member 94 is allowed to move relative to the member 92 as the belt 24 is moved over the member 94. In a preferred embodiment, as illustrated in FIG. 14, the member 94 is a tube-like member that is preferably made of plastic, that is positioned around the tube-like member 92, with the member 94 having a larger internal diameter than an outside diameter of the member 92. As such, when the belt 24 is moved over the member 94, the member 94 is allowed to rotate or roll about the member 92. Because the member 94 is provided between the belt 24 and the member 92, the amount of friction between the belt 24 and the member 94 and between the member 94 and the member 92 is substantially less than that directly between the belt 24 and the member 92. As such, the provision of the member 94 allows for the belts 24 of the manure removal and drying machine 23 to have a length which is substantially longer than those that are presently used in prior art manure removal and drying machines 21. Prior art manure removal and drying machines 21 are known to have a maximum length of approximately 260 feet, whereas the manure removal and drying machine 23 having the friction reduction system 90 incorporated therein can have lengths of at least 375 feet, which allows for a more cost effective configuration of the manure removal drying machine 23 and, thus, the manure removal and drying system 20.

The selective capacity control system 25, the static pressure control system 30, the moisture sensing control system 50, the automatic variable speed loading system 70, and the friction reduction system 90 of the manure removal and drying system 20 are described and illustrated herein as being independent of one another, but it is to be understood that each of the selective capacity control system 25, the static pressure control system 30, the moisture sensing control system 50, the automatic variable speed loading system 70, and the friction reduction system 90 of the manure removal and drying system 20 can be operatively associated with one another such that the activation and operation of one system affects the activation and operation of another system. As discussed previously, the controllers 32, 52, 72 of the static pressure control system 30, the moisture sensing control system 50 and the automatic variable speed loading system 70 can be one single controller configured to perform the desired operations of each of the systems 30, 50, 70. By way of example, the level of static pressure sensed by the static pressure sensor 34 of the static pressure control system 30 and conveyed to the controller 32, which can also be the manure belt controller 72 of the automatic variable speed loading system 70, can dictate at what speed the variable speed motor drive 78 drives the manure belts 24 regardless of the amount of manure sensed by the manure position sensor 74. Likewise, the actions of the selective capacity control system 25 and the moisture sensing control system 50 may be affected by the static pressure control system 30, and vice versa. Also, the friction reduction system 90 can be incorporated into the manure removal and drying machine 23 regardless of whether the manure removal and drying machine 23 has none, one or more of the systems 25, 30, 50, 70.

While preferred embodiments of the invention are shown and described, it is envisioned that those skilled in the art may devise various modifications without departing from the spirit and scope of the foregoing description and the appended claims.

The invention is claimed as follows:

1. A system associated with the removing and drying of manure in an agricultural setting, said system comprising at least one of the following:

a static pressure control system for regulating an amount of static pressure in a high pressure area of the agricultural setting;

a variable speed loading system for varying a speed of operation of said system based on an amount of manure being removed and dried in the agricultural setting;

a moisture sensing control system for detecting moisture from the manure in order to activate or deactivate said system;

a selective capacity control system for selectively scaling a distance the manure in the agricultural setting is moved; and a friction reduction system for reducing the buildup of friction within said system caused by the movement of belts.

2. The system as defined in claim 1, wherein said moisture sensing control system comprises:

a conveyor configured to move the manure;

a controller having at least one programmed manure moisture level;

an actuator which is in communication with said controller and which is configured to move or stop said conveyor; and a sensor operatively associated with said conveyor and in communication with said controller, said sensor configured to sense a level of moisture from the manure on said conveyor and to convey said sensed level of moisture to said controller;

whereby, upon receiving said sensed level of moisture from said sensor that is equal to or greater than said at least one programmed manure moisture level, said controller instructs said actuator to move said conveyor, and whereby, upon receiving said sensed level of moisture from said sensor that is less than said at least one programmed manure moisture level, said controller instructs said actuator to stop said conveyor.

3. The system as defined in claim 2, wherein said conveyor is a belt.

4. The system as defined in claim 2, further comprising at least one safety sensor that is operatively associated with said conveyor and in communication with said controller, whereby when said at least one safety sensor senses a malfunction of said conveyor, said safety sensor conveys the sensed malfunction to said controller whereby said controller instructs said actuator to stop said conveyor regardless of level of moisture of manure on said conveyor.

5. The system as defined in claim 2, wherein said controller may have more than one programmed level of moisture.

6. The system as defined in claim 5, wherein said conveyor may run at different speeds dependent on said sensed level of moisture.

7. The system as defined in claim 1, wherein said static pressure control system comprises:

a pressure bypass provided between a high pressure area and a low pressure area;

a controller having at least one programmed static pressure level;

an actuator which is in communication with said controller and which is configured to open or close said pressure bypass; and a sensor positioned within said high pressure area and which is in communication with said controller, said sensor configured to sense a level of static pressure within said high pressure area and to convey said sensed level of static pressure to said controller;

whereby, upon receiving said sensed level of static pressure from said sensor that is equal to or greater than said at least one programmed static pressure level, said controller instructs said actuator to open said pressure bypass to allow static pressure within said high pressure area to flow to said low pressure area, and whereby, upon receiving said sensed level of static pressure from said sensor that is less than said at least one programmed static pressure level, said controller instructs said actuator to close said pressure bypass to prevent static pressure within said high pressure area from flowing to said low pressure area.

8. The system as defined in claim 7, wherein said pressure bypass is a wall within a partition that is configured to open to allow communication between said high pressure area and said low pressure area and to close to prevent communication between said high pressure area and said low pressure area.

9. The system as defined in claim 7, wherein said pressure bypass is a valve configured to open to allow communication between said high pressure area and said low pressure area and to close to prevent communication between said high pressure area and said low pressure area.

10. The system as defined in claim 7, wherein said controller may have more than one programmed static pressure level.

11. The system as defined in claim 10, whereby, upon receiving said sensed level of static pressure from said sensor that is equal to or greater than a first programmed static pressure level, said controller instructs said actuator to open said pressure bypass to a first degree of openness, and whereby, upon receiving said sensed level of static pressure from said sensor that is equal to or grater than a second programmed static pressure level but less than said first programmed static pressure level, said controller instructs said actuator to open said pressure bypass to a second degree of openness, wherein said second degree of openness is less than said first degree of openness.

12. The system as defined in claim 1, wherein said variable speed loading system comprises:

a conveyor configured to move the manure;

a controller operatively associated with said conveyor, said controller being configured to control a speed at which said conveyor moves the manure; and a sensor in communication with said controller, said sensor being configured to sense an amount of manure on said conveyor and to convey said sensed amount of manure to said controller;

whereby, upon receiving said sensed amount of manure from said sensor, said controller causes said conveyor to move at a desired rate of speed based on said sensed amount of manure, said controller being further configured to cause said conveyor to move at a generally fast rate of speed based on a generally large sensed amount of manure, and to cause said conveyor to move at a generally slow rate of speed based on a generally small sensed amount of manure.

13. The system as defined in claim 12, wherein said conveyor is driven by a motor, said controller being operatively associated with said motor.

14. The system as defined in claim 12, wherein said conveyor is a belt.

15. The system as defined in claim 12, further comprising a flapper positioned relative to said conveyor to come in contact with manure on said conveyor, wherein said sensor is configured to sense movement of said flapper relative to said conveyor caused by contact with the manure on said conveyor in order to sense the amount of manure on said conveyor.

16. The system as defined in claim 15, wherein said flapper is positioned above said conveyor and configured to pivot about a fulcrum, said sensor being configured to sense a change in angle of said flapper relative to said conveyor in order to sense the amount of manure on said conveyor.

17. The system as defined in claim 15, wherein a small sensed movement of said flapper relative to said conveyor indicates a small amount of manure on said conveyor, and wherein a large sensed movement of said flapper relative to said conveyor indicates a large amount of manure on said conveyor.

18. The system as defined in claim 12, wherein the rate of speed at which said conveyor can move is variable to allow for consistent flow of manure.

19. The system as defined in claim 12, further comprising at least one safety sensor that is operatively associated with said conveyor and in communication with said controller, whereby when said at least one safety sensor senses a malfunction of said conveyor, said safety sensor conveys the sensed malfunction to said controller whereby said controller causes said conveyor to stop from moving regardless of the amount of manure on said conveyor.

20. The system as defined in claim 1, wherein said selective capacity control system comprises:

a first conveyor configured to move the manure in a first direction;

a second conveyor positioned below said first conveyor such that the manure moved by said first conveyor can drop onto said second conveyor, said second conveyor configured to move the manure in a second direction; and a surface positioned below said second conveyor such that the manure moved by said second conveyor can drop onto said surface;

whereby, said second conveyor is configured to be movable such that the manure moved by said first conveyor can drop directly onto said surface and bypass said second conveyor.

21. The system as defined in claim 20, wherein said first direction is generally opposite said second direction.

22. The system as defined in claim 20, further comprising a third conveyor and a fourth conveyor, wherein said fourth conveyor is said surface, and wherein said third conveyor is positioned below said second conveyor such that the manure moved by said second conveyor can drop onto said third conveyor, said third conveyor being configured to move the manure in a third direction, and wherein said fourth conveyor is positioned below said third conveyor such that the manure moved by said third conveyor can drop onto said fourth conveyor, said fourth conveyor being configured to move the manure in a fourth direction.

23. The system as defined in claim 22, wherein said third direction is the same as said first direction, and wherein said fourth direction is the same as said second direction.

24. The system as defined in claim 22, wherein said first, second, third and fourth conveyors are configured in a vertical arrangement in a staggered relationship.

25. The system as defined in claim 22, wherein an end of said first conveyor where the manure drops from said first conveyor is co-planar with an end of said third conveyor where the manure drops from said third conveyor, and wherein an end of said second conveyor where the manure drops from said second conveyor is co-planar with an end of said fourth conveyor where the manure drops from said fourth conveyor.

26. The system as defined in claim 1, wherein said friction reduction system comprises:

a first member that is fixed in position;

a second member that is positioned around said first member and which is movable about said first member; and a conveyor configured to move in a direction which is transverse to lengths of said first and second members, said conveyor being in contact with said second member such that movement of said conveyor causes said second member to move about said first member.

27. The system as defined in claim 26, wherein said conveyor is an elongated belt.

28. The system as defined in claim 26, wherein said first and second members are both tube-like members, said first member being positioned within said second member such that said first member has an outer diameter that is smaller than an inner diameter of said second member, said second member being configured to rotate about said first member.

29. The system as defined in claim 26, wherein said first member is made of metal.

30. The system as defined in claim 26, wherein said second member is made of plastic.

* * * * *